United States Patent [19]

Bertin et al.

[11] 3,937,133

[45] Feb. 10, 1976

[54] OUTLETS FOR CONDITIONED AIR AND MOUNTING FRAMES THEREFOR

[76] Inventors: Mannie Bertin, 47 Linron Drive, Danbury, Conn. 06810; Ira L. Bertin, Box 25, Limington, Maine 04049

[22] Filed: Sept. 27, 1974

[21] Appl. No.: 510,001

[52] U.S. Cl. ..... 98/40 D; 98/114; 98/121 R; 52/586; 312/111; 312/257 R; 312/263

[51] Int. Cl.[2] ..... F24F 13/14

[58] Field of Search ..... 98/40 D, 40 C, 114, 121 R, 98/121 A, 40 VM; 312/245, 248, 107, 111; 52/471, 586

[56] References Cited

UNITED STATES PATENTS

| | | | |
|---|---|---|---|
| 747,120 | 12/1903 | Beaumont | 52/471 X |
| 3,202,082 | 8/1965 | Viehmann | 98/114 X |
| 3,422,744 | 1/1969 | Tarnoff | 98/121 R |
| 3,654,851 | 4/1972 | Bertin et al. | 98/110 |
| 3,756,138 | 9/1973 | Box | 98/40 VM |
| 3,793,932 | 2/1974 | Tarnoff | 98/121 R X |
| 3,833,989 | 9/1974 | McCabe | 98/121 R X |

*Primary Examiner*—William E. Wayner
*Assistant Examiner*—William E. Tapolcai, Jr.

[57] ABSTRACT

An outlet for conditioned air has a plurality of interconnected modules establishing its side walls which support a closed bottom and by which the outlet is connected to a mounting frame. Each module has a supporting frame consisting of upper and lower side members and end members, each a length of an extrusion providing an outer wall and an inwardly disposed wall. Means are provided to interconnect the frames to each other vertically or laterally in the same plane or at right angles in a manner providing air tight seals.

Each module also includes a series of air deflection and dampering units, each unit having a pair of dampers and a pivot connecting them to the inwardly disposed walls of the upper and lower side members of the frame close to the outer edges thereof and which also have friction strips in engagement with the dampers to pervent the accidental displacement of the units or their dampers from set positions and the pivots also interconnect the inwardly disposed walls of the upper and lower members to hold the friction strips in substantially uniform contact with the top and bottom edges of the dampers.

Each module or planar assemblies thereof may be used with frames formed from the same extrusions as wall registers and the modules may include filters or grille work in lieu of air deflection and dampering units.

15 Claims, 18 Drawing Figures

OUTLETS FOR CONDITIONED AIR AND MOUNTING FRAMES THEREFOR

BACKGROUND REFERENCES

U.S. Pat. No. 3,654,851, and U.S. Ser. No. 384,041, filed July 30, 1973.

BACKGROUND OF THE INVENTION

The delivery of conditioned air into a space from a duct opening through an outlet in the ceiling requires the use of an air outlet that must enable the volume and direction of the air to be adjusted to ensure its proper distribution throughout the served space.

The use of large capacity air conditioners has introduced new problems in diffusing conditioned air as they necessitate larger diffusers with the diffuser size depending on the capacity of the air conditioner and the size of the ceiling-mounted outlet but with the troublesome requirement that they be quiet in operation in spite of the increase in the volume of the conditioned air. By way of example, air conditioners rated at 75 tons or more capacity are commonly used at the present time and static pressures are often in the range of 5 inches in order to accommodate the massive air distribution duct system.

THE PRESENT INVENTION

The general objectives of the present invention are first, the provision of air outlets, particularly those that are air diffusers, that are quiet in operation regardless of the capacity of the air conditioners or the static pressure in the system and, secondly, the provision of modular constructions thereof that make any size requirement easily attainable independently of the size of the outlet of the air duct or the capacity of the air conditioner with which the duct is in communication.

In accordance with the invention, these general objectives are attained with an air outlet consisting of interconnected modules and a mounting frame therefor, each module including a frame consisting of upper and lower side members and end members and structure supported thereby, which may be grille work, filters or horizontal deflection blades but is herein discussed primarily as air deflection or dampering units. While the invention, as thus broadly defined, is generally similar to the structures disclosed in the above referred-to patent and patent application, important differences exist in the mounting frame, the frames of the modules, in the means by which the modules are interconnected and connected to the mounting frame, and in the air deflection and dampering units and their incorporation in the modules.

In accordance with the present invention, the general objectives, in the case of the modules, are attained by providing, for whatever structure the modules are to include, frames having upper and lower side members and end members, with each member an appropriate length of an extrusion including an outer or side wall and a supporting wall for the structure extending inwardly adjacent one edge thereof. The extrusion also has a splineway extending from end-to-end thereof adjacent the other edge of the outer wall and disposed towards the supporting wall an entrance extending lengthwise of the side wall close to its opposite edge.

Another objective of the invention is to provide for the connection of one module to another, an objective attained, when two modules are to be connected one above the other or in an end-to-end relationship, with a flat connector having a spline portion extending along each edge with each spline portion shaped and dimensioned to enter one or the other of the splineways or splineway entrances of the abutting frame members of the two modules and locking them together when the modules are held co-planar and providing an air tight seal.

Another objective of the invention is to enable the ends of two modules to be connected at a predetermined angle, typically a right angle, an objective attained with a connector having two plane surfaces disposed relative to each other at said predetermined angle and with each surface having a spline portion extending lengthwise thereof, each spline portion shaped and dimensioned for entry into the splineway of an appropriate one of the proximate end frame members of the two modules that are to be connected and locking them together when they are disposed and held in said angular relationship and also providing an air tight seal.

Another objective of the invention is to enable the modules to be quickly and easily attached to a ceiling-located mounting frame, and objective attained by providing mounting frames consisting of interconnected members, each an appropriate length of an extrusion provided with a depending spline portion shaped and dimensioned to enter the splineway entrance of the upper frame side member of the module which it is to support and locking the module thereto and providing an air tight seal when the module is disposed and held at right angles to the ceiling.

Another objective of the invention is to provide that the modules, when completed by the attachment of the structures to their frames, will be rigid even with light weight extrusions, an objective attained by connecting the structure to the upper and lower side members of each module frame in a manner also interconnecting their inwardly disposed supporting walls closely adjacent the side walls.

Another important objective of the invention is to ensure that when the structure supported by the module frame is a series of air deflection and dampering units, the air deflection and dampering units effect desired air distribution patterns without being the cause of noise regardless of the volume of air flowing through the modules per unit of time, an objective attained with air deflection and dampering units each of which includes a pair of dampers connected by a pivot at one end to the supporting walls of the upper and lower frame members adjacent their outer edges and so shaped that when their other ends are closed together, they do not protrude beyond the inner edges of the supporting wall and the unit has the form of a tear with its small end, the outer end and rounded and so constructed that in any position of the deflection and dampering units or their dampers, surfaces are exposed at their outer ends that curve away from the air streams. When the dampers are swung apart they define substantially leak-proof pockets and, when all the dampers of a module are thus positioned, they function to back up the air flow and thus increase the air flow through the other modules.

Another objective of the invention is to ensure that, when, as is usually the case, the air deflection units and their dampers are to be independently adjustable, the air deflection units and their dampers will stay in any position in which they are set, an objective attained by providing the supporting walls of the upper and lower side members of the module frames with friction strips that are in engagement with the dampers and by connecting the pivots of the air deflection units to those supporting walls in a manner also interconnecting the supporting walls thus to maintain the friction strips in substantially uniform contact with all the dampers and avoid the necessity of using such thick-walled extrusions that would be uneconomical and otherwise objectionable.

Yet another objective of the invention is to provide air deflection and dampering units that not only ensure quiet operation but also provide for ease of assembly, an objective with an air deflection unit having first and second dampers interconnected by a pivot with the rear ends of the dampers curved inwardly towards each other. The front end of the first damper has an arcuate channel that is more than 180° in extent. The front end of the second damper has a bearing and a connecting web with the bearing dimensioned for slidable entry into the channel of the first damper and having an axial passage extending therethrough for the pivot. The web is disposed to enable the dampers to be rotatable relative to the pivot with the extremities of their curved ends abutting or swung apart to a predetermined extent.

A further objective of the invention is to provide a mounting frame that is adapted for attachment to the walls of the duct for the conditioned air either at an end thereof or marginally of a port in its side wall, an objective attained with an extrusion for the mounting frame members that has first and second walls disposed at right angles to each other. The first wall has a depending spline portion extending lengthwise thereof adjacent its outer edge and the second wall has a series of score lines parallel with the front wall and spaced therefrom and from each other to enable a selected portion of the second wall to be bent to overlie the first wall as required by the wall thickness of a duct having a side wall port to which the mounting frame is to be attached. The second wall when not so bent is also attachable to the wall of a duct at its open end.

Another objective of the invention is to ensure that the frame members of each module and of the mounting frame are tightly joined together, an objective attained by providing the extrusion from which the frames are formed with undercut slots extending lengthwise of their inner surfaces and connectors having angularly disposed arms, each for entry into that slot of the appropriate one of the frame members that are to be joined together. After the angular connector is in place, the mitered ends of the frame members are substantially in abutment and each arm of the connectors is then anchored in a manner drawing and holding the abutting ends tightly together.

BRIEF DESCRIPTION OF THE DRAWINGS

The accompanying drawings illustrate preferred embodiments of the invention and

THE PREFERRED EMBODIMENTS OF THE INVENTION

Figure 1:
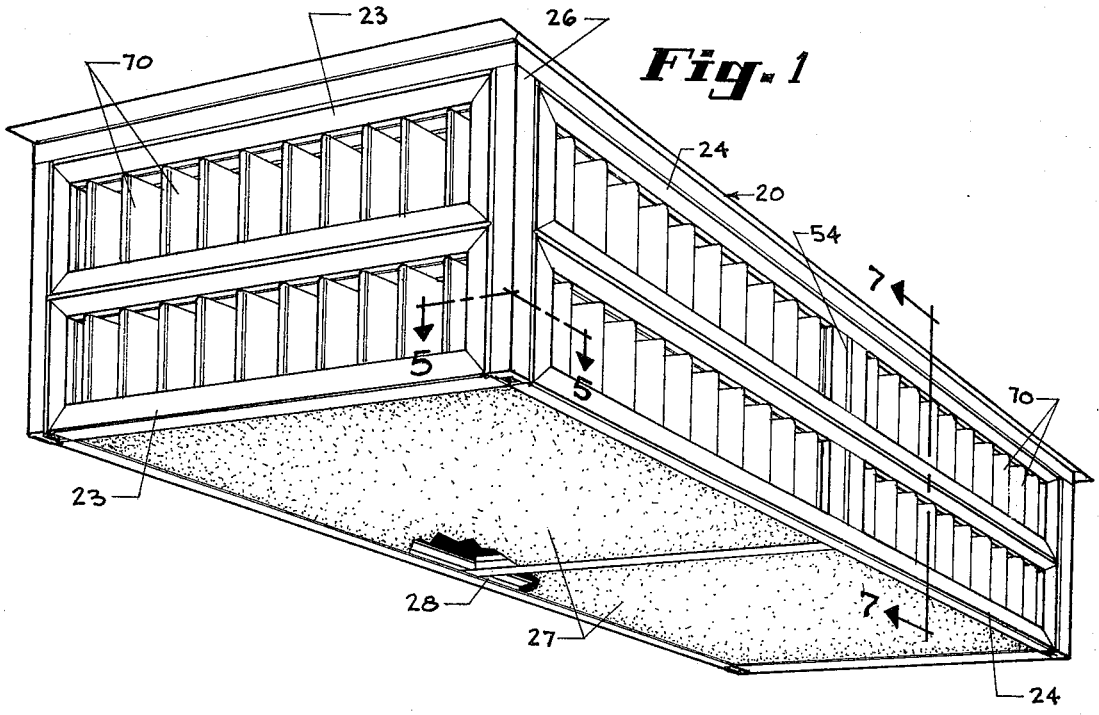
FIG. 1 is a perspective view of an air outlet as seen from below, the outlet, a ceiling mounted air diffuser.
Figure 2:
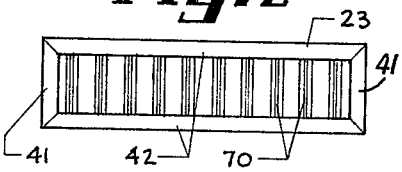
FIG. 2 is a front view of one of the modules employed in the assembly of the ends of the diffuser.
Figure 3:
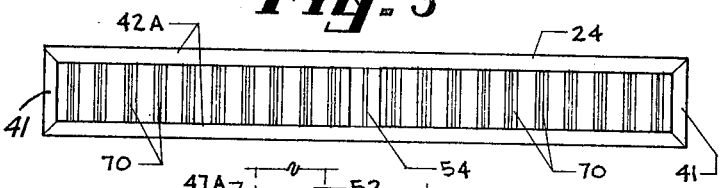
FIG. 3 is a like view of one of the modules employed in the assembly of the sides of the diffuser.
Figure 6:
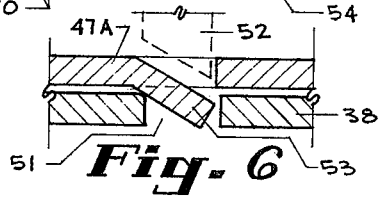
FIG. 6 is a fragmentary section, on a further increase in scale, taken lengthwise of the interlock between an angular connector and a frame member.
Figure 7:
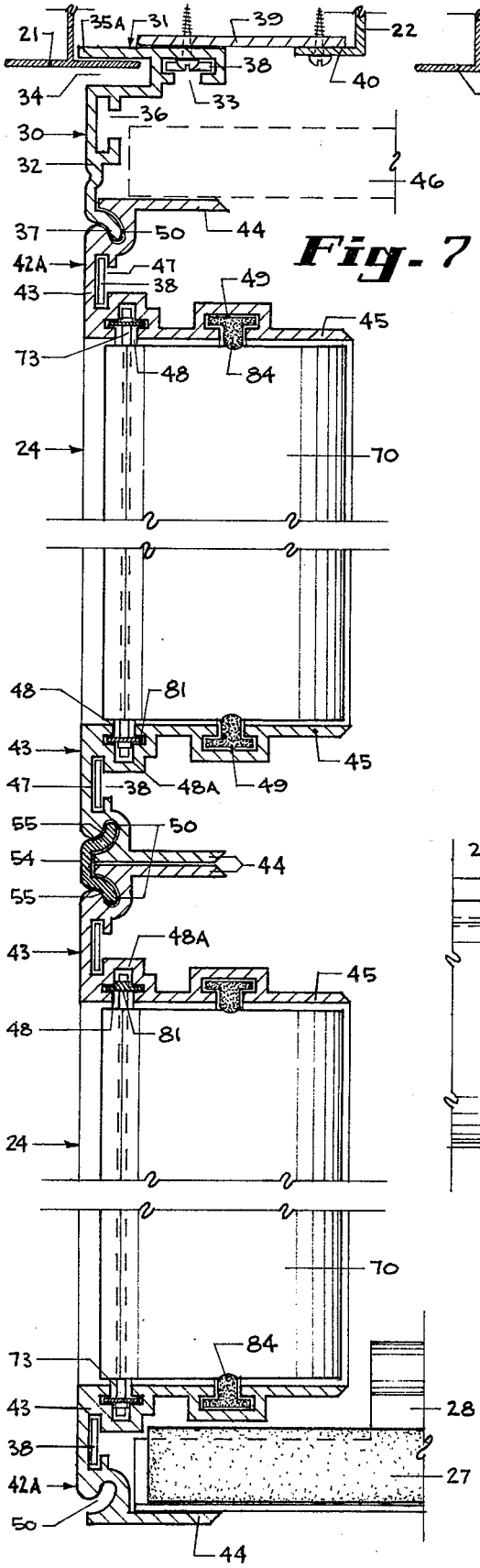
FIG. 7 is a section, on the scale of FIG. 5, taken approximately along the indicated line 7—7 of FIG. 1, and broken away to foreshorten the drawing.
Figure 8:
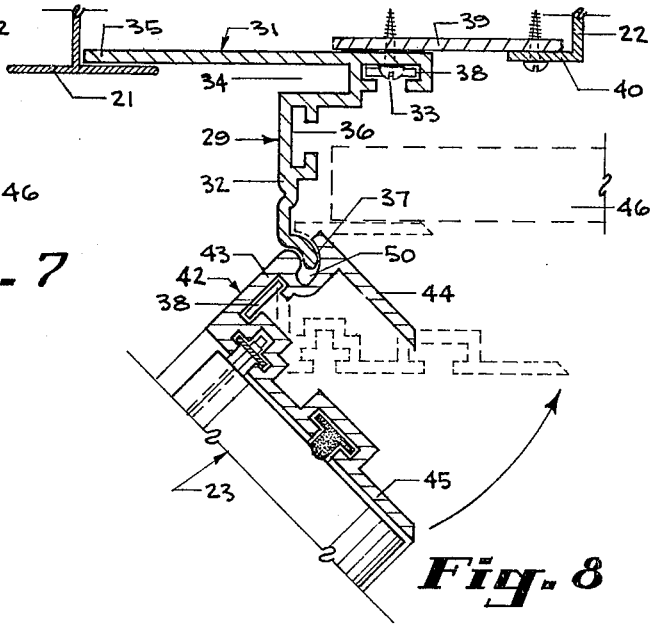
FIG. 8 is a fragmentary section, similar to the upper part of FIG. 7, illustrating the connection of the upper end module to a ceilingsupported mounting frame.

The air outlet illustrated by FIGS. 1 – 9 is an air diffuser having its mounting frame, generally indicated at 20, marginally supported by the framework 21, see FIGS. 7 and 8, of a suspended ceiling and surrounding and sealed to the outlet end 22 of a duct for conditioned air, in the instant case, air from an air conditioner not shown.

The mounting frame 20 supports an upper series of modules generally indicated at 23 and 24 and providing the ends and sides, respectively, of the upper portion of the air diffuser and a lower series of like modules that provide the ends and sides of a similarly shaped lower portion thereof. The modules of both series are interconnected by corner connectors 26. The modules 23 and 24 of the lower series are shown as closed by bottom panels 27 which are usually, but not necessarily identical in size and shape to those supported by the framework 21. The two panels 27 shown in FIG. 1 have their proximate edges supported by a T-shaped spacer 28. It will be noted that the modules 24 are twice as long as the modules 23 and consist of two modules 23 whose proximate ends are joined together.

The end members of the mounting frame 20 are formed from mitered lengths of an extrusion, generally indicated at 29 in FIG. 8, and its side members are formed from mitered lengths of an extrusion, generally indicated at 30 in FIG. 7. The extrusions 29 and 30 are preferably aluminum as are the other extrusions subsequently to be referred to.

The extrusion 29, see FIG. 8, has a first wall 31 and a second or side wall 32 disposed at right angles thereto with the first wall 31 having an inner, downwardly opening lengthwise slot 33 that is T-shaped in cross section and a channel 34 opening outwardly at the junction of the two walls with the upper channel wall extending beyond the side wall 32 to provide a flange 35. The channel 34 receives the framework 21 on which the flange 35 rests. The extrusion 30 is identical except that its flange 35A is substantially shorter than the flange 35 and, accordingly, the same reference numerals are employed to designate its identical portions. The difference in flange length is attributable to the slight difference between the dimensions of the framework that is to support the diffuser and those of the diffuser as far as lengths are concerned.

The inner surface of the side wall 38 has in its upper portion, an inwardly opening, lengthwise, undercut slot 36, shown as T-shaped in cross section and its lower edge is in the form of a spline portion 37 extending downwardly and inwardly and desirably arcuate with its arcuate extent slightly more than 90°. The mitered ends of the end and side members are interconnected by an L-shaped connector 38, such as that shown in FIG. 4, for example, with each of its arms entered into an appropriate one of the slots 33 of the abutting mounting frame members. With an appropriately shaped connector, the slots 36 may be used to interconnect the frame members. The connectors 38 are locked to the frame members in a manner subsequently to be detailed.

In practice, mounting frames are usually shipped assembled and the space between the mounting frame 20 and the duct outlet 22, see FIGS. 7 and 8, is closed by a frame member 39 secured and sealed to the upper surface of the wall 31 of each mounting frame member above the slot 33 and secured and sealed to the outlet flange 40.

The modules 23 and 24 have their ends and upper and lower side members formed from mitered lengths of an extrusion. The end members 41 of both the modules 23 and 24 are of the same length but the top and bottom side members 42A of the module 24 are twice as long as the side members 42 of the module 23. The extrusion from which the module frames are formed has, see FIGS. 7 – 9, a side wall 43 and parallel walls 44 and 45 disposed at right angles thereto and extending in the same direction from its margins. The wall 44 is shorter than the wall 45 and has the function of supporting a portion of a panel 27 and the spacer 28 when its side member 42, 42A of which it is a part is the lower side member of a lower module and of supporting an accessory 46 when the side members 42, 42A of which it is a part is the upper side member of a module, usually and as shown, the upper module. The accessory 46 may be a filter, fire damper, or electric heater, for examples and such accessories may also be used in place of the panels 27 and it should be noted that for the support of panels 27 or an accessory, it is necessary to blank out the bevelled ends of the walls 44 of the end members of the frames. The outer edges of the walls 44 and 45 are bevelled to lie in the same plane.

The side wall 43 has an undercut slot 47, shown as T-shaped in cross section extending lengthwise of its inner surface and the outer surface of the wall 45 has lengthwise parallel undercut slots 48 and 49, both shown as T-shaped in cross section with the slot 48 located as close to the outer face of the side wall 43 as is practicable and having a bottom channel 48A. The walls 45 of two opposite frame members of the modules are the supporting walls for the air affecting means and the slots 48 are used to effect their connection therewith by means later to be described. A splineway 50 extends lengthwise of the junction of the walls 43 and 44.

Figure 4:
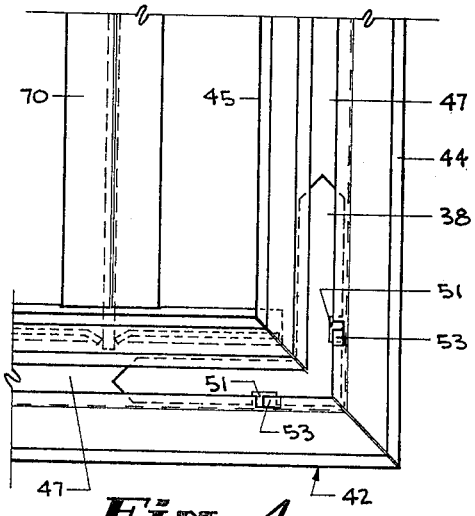
FIG. 4 is a fragmentary rear view, on an increase in scale showing a corner of a module showing a connector joining two frame members and locked thereto.

The mitered ends of the members forming the frames of the modules 23 and 24 are locked together by connectors 38. As shown in FIGS. 4 and 6, each arm of the connectors 38 has a marginal notch 51 so dimensioned that it is partly exposed when that arm is fully entered into a slot 47. When both arms of a connector 38 are thus entered in the slots 47 of the two frame forming members that are to be locked together thereby, their mitered ends abut. By means of a punch 52, the material 47A overlying the notched side of the connector arms is cut to provide a locking tab 53 driven into the subjacent notch 51 in a direction such that when both connector arms are so locked, the abutting mitered ends are forced tightly together.

The splineway 50 is curved inwardly towards the wall 45 with an entrance opening through the side wall 43 close to the wall 44 with its inner end substantially at right angles to the entrance. The outer splineway wall establishes a bearing 50A at the entrance and the inner splineway wall establishes a shoulder 50B at the entrance terminating short of the plane of the outer surface of the wall 43 but it and the bearing 50A are at least partly in a plane parallel thereto. The splineway 50 is of a size and shape freely to receive a spline portion 37 of a member of the mounting frame 20 in the manner illustrated in FIG. 8 and to be secured therein when the module of which it is a part is swung from its full line position into its dotted line position and then held as it is when connected to adjacent modules similarly supported by the mounting frame 20.

Figure 9:
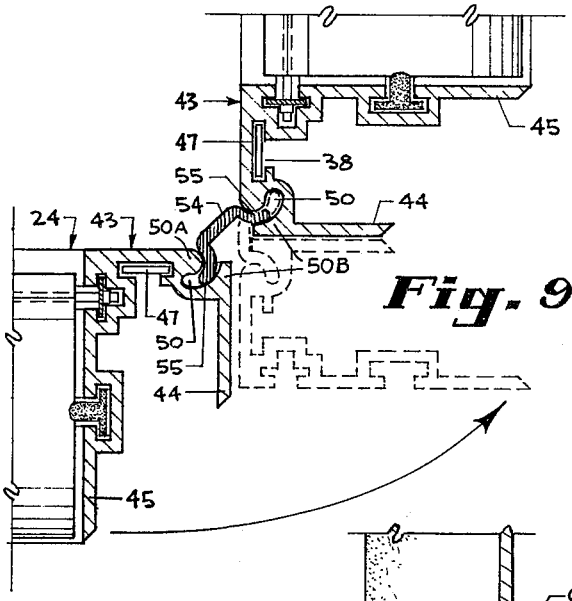
FIG. 9 is a like view illustrating the attachment of the lower side module of FIG. 7 to the upper module.

When, as in the case of the air diffuser being described, there are upper and lower series of modules, the side members of the lower modules are connected to the lower side member of the lower modules of the upper series that are already secured to the mounting frame 20. For that purpose, connectors 54, see FIGS. 7 and 9, are provided that are flat faced and have marginal, arcuate spline portions 55 each of the size and shape of the spline portions 37 of the mounting frame and curved inwardly and away from each other, each spline portion 55 for entry into the appropriate one of the splineways 50 of the proximate side members of the two modules to be connected. When the lower module is swung from its full to its dotted line position shown in FIG. 9, the two modules are interconnected and held in that position when the lower module is also connected at least at one end to another module of the lower series. The interconnected frame members are held substantially in abutment with the shoulders 50B in contact with the connector 54 adjacent its spline portions.

Figure 13:
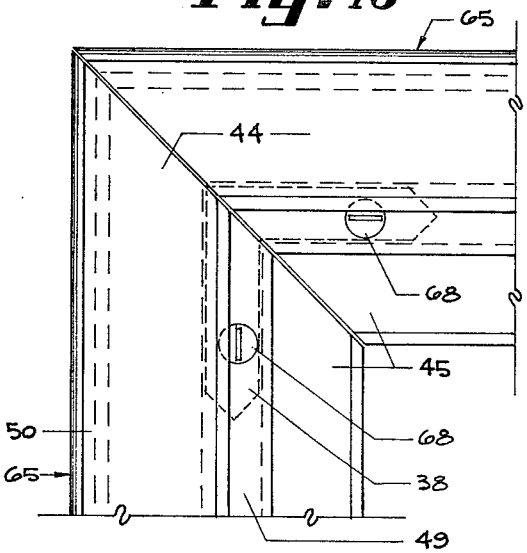
FIG. 13 is a fragmentary view showing a corner of the wall-supported mounting frame.
Figure 14:
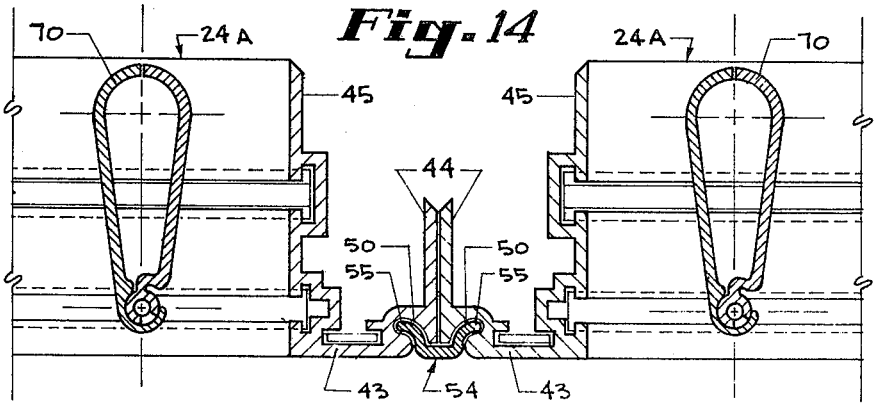
FIG. 14 is a section, taken approximately along the indicated line 14—14 of FIG. 11.

Where, as in the case of the modules 24 or the modules 23A of the wall mounted diffuser shown in FIGS. 11 – 14, two modules are to be joined end-to-end in the same plane, the connectors 54 may also be used with its spline portions 55 now entered in the splineway 50 of the proximate end members of the module fames as may best be seen in FIG. 14 where the modules 23A are shown as so connected.

Figure 5:
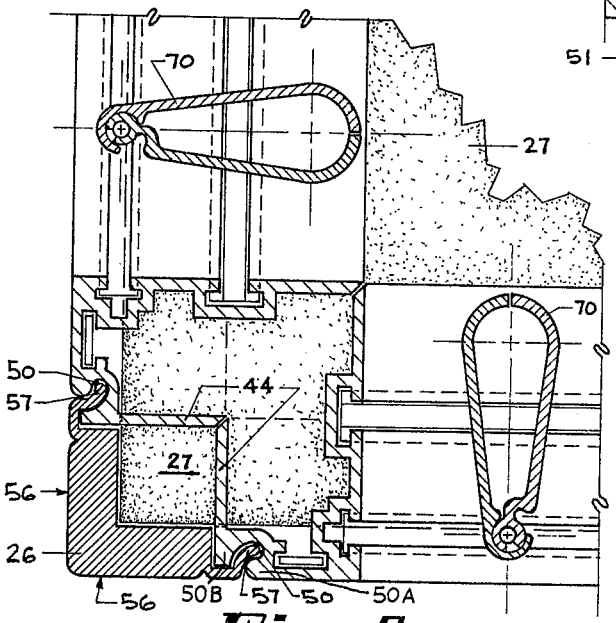
FIG. 5 is a section, on a further increase in scale, taken approximately along the indicated line 5—5 of FIG. 1.

The ends of the modules 23 and 24 are joined by the corner connectors 26, see FIG. 5. Each corner connector has side sections 56 disposed at right angles to each other and each has a marginal spline portion 57 similar in size and shape to the spline portions 37 and 55 and disposed so that each may be slidably entered into the end of the splineways 50 of the end members 40 of two modules 23, 24 when disposed at right angles and with the bevelled ends of corresponding walls 44 and 45 abutting.

Figure 10:
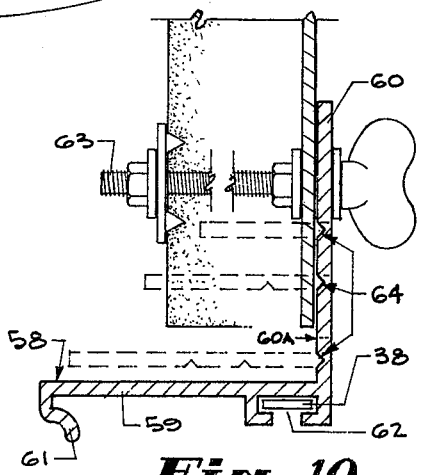
FIG. 10 is a section taken through a side of a mounting frame member in accordance with another embodiment of the invention.
Figure 11:
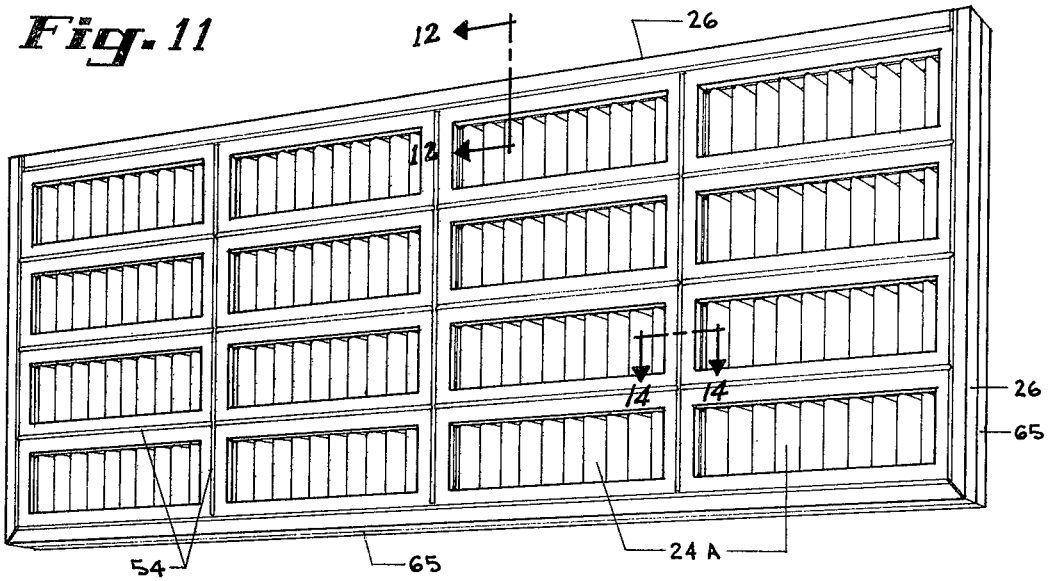
FIG. 11 is a front perspective view of an outlet in accordance with another embodiment of the invention with the air outlet in the form of a wall-supported register.
Figure 12:
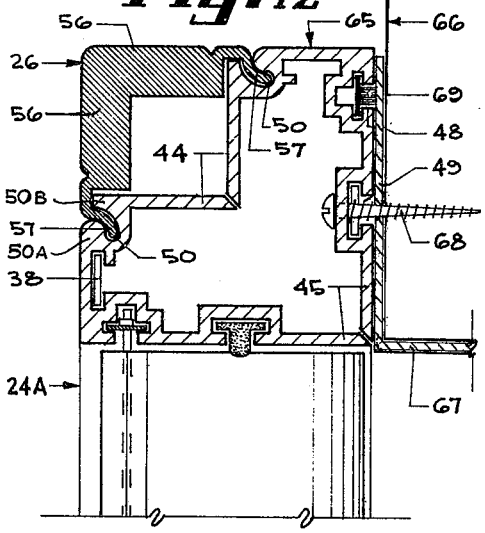
FIG. 12 is a section, on an increase in scale, taken approximately along the indicated line 12—12 of FIG. 11.

Reference is now made to FIG. 10 wherein a member generally indicated at 58 is shown for use in forming a mounting frame that may be attached directly to the walls of an outlet end of a duct or marginally of a port in its side wall. The member 58 is a length of an extrusion having walls 59 and 60 disposed at right angles to each other with the wall 59 having its outer edge a lengthwise and depending spline portion 61 similar to the spline portions 37 and, adjacent its other edge, a downwardly opening slot 62 that is T-shaped in cross section and for use in receiving an arm of a connector 38. The wall 60 is adapted to be connected to the wall of the duct at its outlet end by a bolt 63 regardless of the thickness of the duct wall which may be of sheet metal or fibreglass as typical examples and the wall 60 has a lengthwise slot 60A opening through the upper end to enable the mounting frame formed from the member 58 to be vertically adjusted relative to the duct. The inner surface of the wall 60 of the extrusion 58 has three parallel score lines 64 spaced from the wall 59 and from each other. When a mounting frame consisting of lengths of the extrusion 58 is to be connected to a port in the side wall of a duct, the score lines enable that portion of the wall 60 to be bent to overlie the wall of the duct that leaves the remainder of the wall 60 approximately the thickness of the duct wall.

Where the outlet is to be a wall mounted register, see FIGS. 11 –14, an appropriate number of the modules 24A are connected in a planar relationship in the above described manner but the mounting frame therefor, generally indicated at 65, is formed from opposite lengths of the extrusion used in constructing the frames of the modules.

The members of the frame 65 are shown as secured to a wall 66 marginally of a flanged port 67 by screws 68 extending through the wall 45 and its slot 49 and into the wall 66 and as shown in FIG. 13 also anchoring a connector 38. A sealing strip 69 is held in the slot 48.

The assembly of the modules 24A is then secured to the wall-attached mounting frame by means of appropriate lengths of the corner connector extrusions 26 which enable the sides and end members of the modules that fit against the mounting frame to be connected thereto by means of the entry of the spline portion 57 into the splineways 50. In practice the ends of the connectors at the bottom of the register are mitered but are cut square at the upper edges thereof to permit the corner connectors 26 at the ends of the register to be slid in place last.

Each module includes structure supported by its frame and the structure, typically means for deflecting air streams and while these may be deflection blades, such means are shown as a series of air deflection and dampering units each generally indicated at 70.

Each air deflection and dampering unit consists of a pair of dampers 71 and 72 and connected to the upper and lower frame members of the modules by a pivot 73 in a manner to be described. The dampers are straight sided with their inner ends 71A and 72A curved towards and engageable with each other and when in such engagement, the unit is substantially tear-shaped but its narrower outer end is rounded.

The damper 71 of each unit 70 has its outer end in the form of an arcuate channel 74 that is more than 180° in extent and defined in part, by a rib 75 on its inner surface enabling the channel 74 to be about 260° in extent. The corresponding end of the damper 72 has a bearing 76 having a lengthwise slot 77 opening into an axial passage 78 dimensioned to receive the pivot 73. The bearing 76 is dimensioned for slidable entry into the channel 74 thus to be rotatably connected thereto. The damper 72 has a web portion 72A adjacent the bearing 76 defining a channel 79 to accommodate the free end of the wall of the channel 74 to enable the dampers 71 and 72 to be swung apart to a desired extent.

The air deflection and dampering units 70 are attached to the top and bottom side members of a module by means of their pivots 73 which extend into the slots 48 wherein they are held in a predetermined spaced relationship. An anchoring strip 81 is inserted in each slot 48 and before such insertion it is provided with a series of appropriately spaced holes 82, one for each pivot 73 and formed by a punch that results in their being tabs 83 that are disposed towards the channels 48A. When a pivot 73 is inserted into a hole 82 the tabs 83 yield to permit an end of the pivot to pass therethrough and they become caught in the notches 80 they form adjacent that end. When both ends of the pivots 73 of the series of units 70 are thus secured, the walls 43 of the upper and lower side members of the module are securely interconnected.

It has been noted that the slots 48 are close to the outer edge of the walls 43 and it will be seen that when the dampers 48 are closed together, their inner ends do not protrude beyond the inner edges of the walls 43. It will also be noted that the curved wall of the damper 71 is always presented to the air stream flowing between the units 70 or between them and the end member of the frame of the module.

Reference is made to the fact that in the disclosed embodiments of the invention the air deflection and dampering units 70 and their dampers 71 and 72 are individually adjustable and in order to prevent the air from moving the units or their dampers from their adjusted positions, friction strips 84 of T-shaped section are inserted in each slot 49 to engage with the top and bottom edge of the dampers 68 and 69 and hold them from being moved by the pressure of the conditioned air delivered to the air diffuser or the register. In practice the friction strips 81 are nylon.

Figure 15:
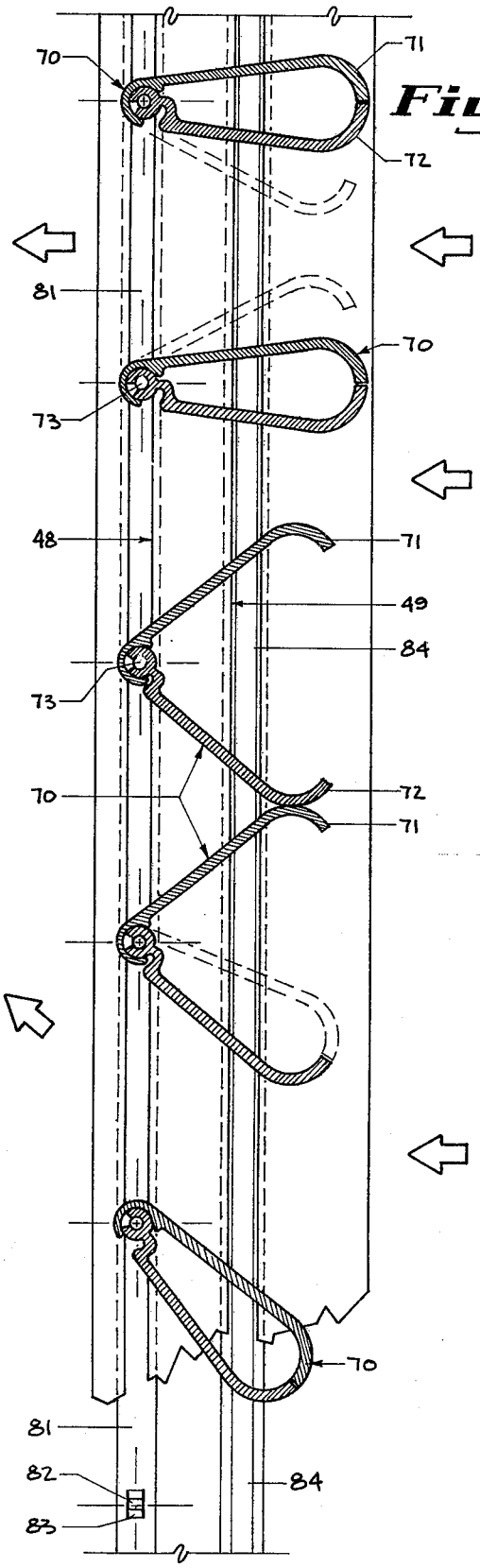
FIG. 15 is a section taken approximately lengthwise of a module showing a series of air deflection and dampering units and illustrating various positions thereof.
Figure 16:
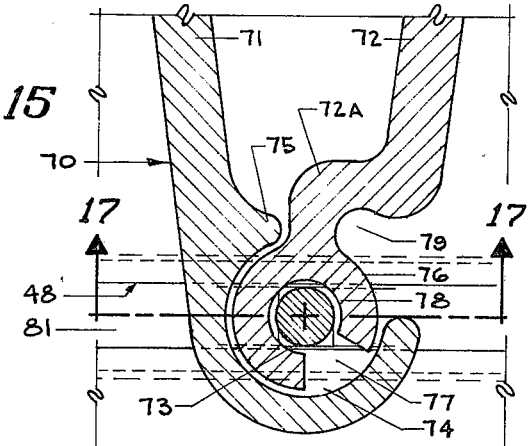
FIG. 16 is a fragmentary and similarly sectioned view, on a further increase in scale, of one of the air deflection and dampering units.
Figure 17:
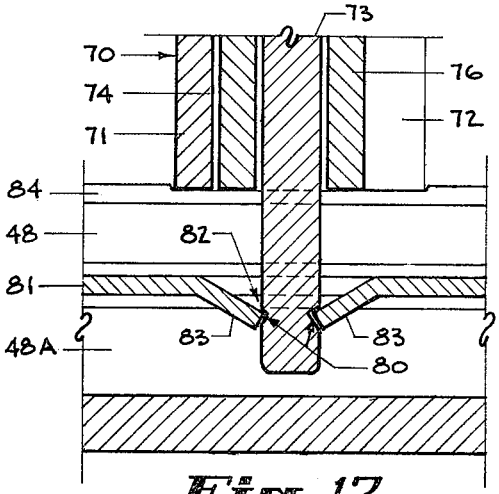
FIG. 17 is a section taken approximately along the indicated line 17—17 of FIG. 16.
Figure 18:
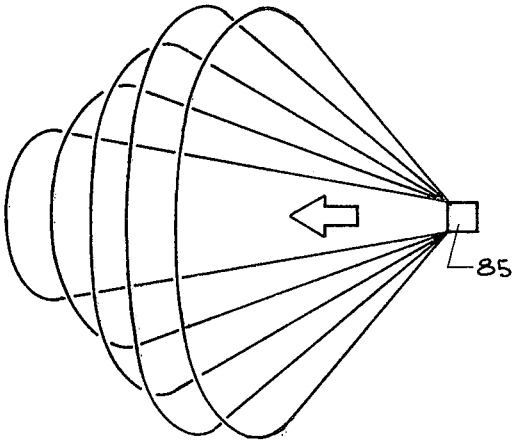
FIG. 18 is a schematic view illustrating various air flow patterns.

Reference is now made to FIG. 18 where an air diffuser is generally indicated at 85 with the series of units 70 at three of its sides having their dampers 71 and 72 spaced apart to block air from escaping therethrough. Various flow patterns are shown with the narrowest one resulting when the units are positioned as shown by the two uppermost units 70 in FIG. 15 and with the widest pattern resulting when the dampers 71 and 72 are positioned in the manner of the proximate dampers of the two lowermost units 70.

From the foregoing, it will be apparent that outlets and mounting frames in accordance with the invention are well adapted to meet its many objectives both in construction, in installation, and in use and that the spline connections between the mounting frames and the modules and between the modules provide seals that are air tight.

We claim:

1. A module for use as a part of an outlet for conditioned air and to support, be supported by, or connected to another part of said outlet, said other part having a spline, said module comprising a frame including upper and lower side members and end members, said members having their ends mitered and abutting, means interconnecting said ends, air affecting means supported by the frame side members, each member an appropriate length of an extrusion including a side wall and a supporting wall extending at right angles thereto adjacent the edge thereof that is the inner edge of the frame, said extrusion also having a splineway the entrance of which extends lengthwise of the outer surface of the side wall adjacent its other edge, the splineway extending inwardly towards the supporting wall with its inner end substantially at a right angle relative to the entrance, the outer surface of the splineway having at the entrance a bearing and the inner surface thereof a shoulder, the entrance and the shoulder at least partly in a plane parallel to said side wall whereby with the spline of said other part of a cross sectional shape generally similar to that of the splineway and dimensioned to be freely slidable lengthwise therein, said other part and said frame are connectable with one angularly displaced relative to the other, with the spline entered in a splineway entrance and the one turned relative to the other with the bearing as the pivot to bring said part and said frame into their desired relationship and to seat the spline fully in said splineway.

2. The module of claim 1 in which at least the inner part of the splineway of the extrusion is substantially arcuate with respect to said bearing.

3. The module of claim 1 in which the splineway from the entrance thereof to the inner end thereof is substantially arcuate with respect to said bearing.

4. The module of claim 1 in which the extrusion has a lengthwise undercut slot extending along the inner surface of its side wall and the means interconnecting the members are corner connectors each including angularly disposed arms, one entered in the slot of a side member and the other entered in the slot of an abutting end member, each arm has a notch under the margin of the slot in which it is located and dimensioned to be partly exposed and said margin includes a tab deformed into said notch in a direction urging said arm to advance in said slot and locking each arm to an appropriate one of the members with the arms holding the proximate, mitered ends in abutment.

5. The module of claim 1 in which the air affecting means is a plurality of air deflecting units each including a supporting pivot, the extrusion has a lengthwise undercut slot extending along the inner surface of its supporting wall, the ends of the pivots are in the last named slots of opposite frame members, and means confined within said last named slots are connected to said pivot ends and connect said pivot ends to said opposite frame members against movement lengthwise relative thereto and hold the supporting walls of said opposite frame members parallel.

6. The module of claim 5 in which the last named slots are T-shaped in cross section and include a bottom channel into which the pivot ends extend, the pivot ends have notches in the bottom channels, and the means connecting the pivots to the opposite frame members are anchoring strips, each anchoring strip having holes arranged to effect the desired spacing of the pivots and tabs bordering the holes and inclined into the bottom channels of an opposite frame member and spaced and dimensioned to catch in said notches when the pivots are forced through the holes.

7. The module of claim 6 in which each air deflection unit also includes two dampers, each damper pivotable relative to said pivot and the opposite frame members are the upper and lower side members, the supporting wall has a second undercut channel between the inner edge thereof and the first named channel, a friction strip in the second channel of said opposite members engages the opposite side edges of the dampers.

8. An outlet for a port in a duct for conditioned air, said outlet including a mounting frame and an air diffuser, means connecting said diffuser to said frame, said diffuser including walls and means interconnecting said walls in a predetermined angular relationship and establishing the corners of the diffuser, each of said walls including at least one module, each module comprising a frame including upper and lower side members and end members, said members having their ends mitered and interconnected in an abutting relationship, each member an appropriate length of an extrusion including a side wall and a supporting wall extending at right angles thereto adjacent an edge thereof and constituting the inner margin of the frame, means interconnecting the abutting ends of said members, air affecting means supported by at least one frame, said extrusion also having a splineway with an entrance extending lengthwise of its outer surface adjacent its other edge and extending inwardly towards the supporting wall with its inner end substantially at right angles to the entrance, the outer surface of the splineway defining a bearing at the entrance and the inner surface thereof defining a shoulder, the bearing and the shoulder at least partly in a plane parallel to said side wall, each corner establishing means including a predetermined length of an extrusion having sides disposed to establish said predetermined angular relationship, each side including a marginal spline portion extending from end-to-end thereof and approximately of the shape of said splineways and a fit therein and dimensioned for entry therein through the ends thereof, said spline portions entered in the splineways of the proximate end frame members and extending from end-to-end thereof, means holding the module connectors from escaping from the splineways in which their spline portions have been entered, and said frame including depending spline portions that are substantially identical to the first named spline portions, said last named spline portions entered within the splineways of the appropriate ones of the frame establishing members of the modules and thereby connect the diffuser to the mounting frame.

9. The outlet of claim 8 in which each wall includes at least two abutting modules, and means interconnect said modules in the same plane, said module connecting means a predetermined length of an extrusion including a center portion and marginal spline portions of approximately the size and shape of the first named spline portions, each of the spline portions of the module connecting means entered into the appropriate one of the splineways of the abutting frame members of said modules.

10. The outlet of claim 9 in which the modules abut in an end-to-end relationship.

11. The outlet of claim 9 in which the abutting modules are arranged one above the other.

12. The outlet of claim 9 in which the center portion of the extrusion is so dimensioned that the interconnected frame members of the module are held substantially in abutment with the outer edge of their shoulders in contact with said center portion.

13. An outlet for a port in a duct for conditioned air, said outlet including a mounting frame and an air diffuser in the form of a register, said diffuser including at least one module comprising a frame including upper and lower side members and end members, said members having their ends mitered and interconnected in an abutting relationship, each member an appropriate length of an extrusion including a side wall and a supporting wall extending at right angles thereto adjacent an edge thereof and constituting the inner margin of the frame, means interconnecting the abutting ends of said members, air affecting means supported by each frame, said extrusion also having a splineway with an entrance extending lengthwise of its outer surface adjacent its other edge and extending inwardly towards the supporting wall with its inner end substantially at right angles to the entrance, the outer surface of the splineway defining a bearing at the entrance and the inner surface thereof defining a shoulder, the bearing and the shoulder at least partly in a plane parallel to to said wall, and means connecting the margins of the diffuser to the mounting frame and including spline portions of substantially the size and shape of the splineways of the frame members that define the margins of the diffuser and entered therein.

14. The outlet of claim 13 in which the mounting frame includes side and end members, each an appropriate length of said extrusion from which the frame members are formed, the mounting frame members and appropriate ones of the module frame members abutting with their corresponding walls at right angles and their splineways exposed at their proximate edges, and the means connecting the diffuser to the mounting frame include corner connectors, each including sides disposed at right angles, each side having a spline portion substantially identical in size and shape to said first named spline portions and entered in said exposed splineways of the mounting frame members and of the proximate module frame members.

15. The outlet of claim 13 in which the means interconnecting the modules in a common plane is an appropriate length of an extrusion including a center portion and marginal spline portions of approximately the size and shape of the first named spline portions, each entered in the appropriate one of the splineways of the abutting frame members.

* * * * *